United States Patent [19]

Wistinghausen et al.

[11] 4,099,363

[45] Jul. 11, 1978

[54] APPARATUS FOR COMPRESSING AND PACKAGING ARTICLES

[75] Inventors: Nikolai K. Wistinghausen; Edward P. Banninga, both of Sarnia, Canada

[73] Assignee: Fiberglas Canada Ltd., Canada

[21] Appl. No.: 814,627

[22] Filed: Jul. 11, 1977

[30] Foreign Application Priority Data

Jun. 23, 1977 [CA] Canada ..... 281207

[51] Int. Cl.[2] ..... B65B 13/20; B65B 63/02

[52] U.S. Cl. ..... 53/124 D; 53/124 TS; 100/226; 100/278

[58] Field of Search ..... 53/124 D, 124 TS, 59 R; 100/278, 226

[56] References Cited

U.S. PATENT DOCUMENTS 3,977,155 8/1976 Spaulding ..... 53/124 TS

*Primary Examiner*—Travis S. McGehee

*Attorney, Agent, or Firm*—Fleit & Jacobson

[57] ABSTRACT

Apparatus for compressing packaging of articles such as insulation batts has a bomb-bay door arrangement for depositing successive batches of the articles in stacked relationship into a downwardly open chamber, and a pressure member movable around an endless path of movement for pressing the articles downwardly at the bottom of the chamber into compression space. A retainer is movable to and from a position overlying the compression space for retaining the articles in their compressed condition in the compression space until the pressure member moves downwardly again through the chamber to compress further articles into the compression space. A ram is provided for discharging the compressed articles from the compression space to a bagging apparatus.

12 Claims, 27 Drawing Figures

12
13
18
19
21
23
66

21
23
25
66
18
19

APPARATUS FOR COMPRESSING AND PACKAGING ARTICLES

FIELD OF THE INVENTION

The present invention relates to apparatus for compressing and packaging articles, and is useful in particular for the compression packaging of batts of glass fibre insulation material.

DESCRIPTION OF THE PRIOR ART

Glass fibre insulation batts are produced in a continuous process on a production line, and have to be compressed and packed in batches in coverings, for example plastic bags.

The apparatuses mostly employed hitherto for compressing and packaging the insulation batts have required considerable manual handling of the insulation batts, after their discharge from a conveyor forming part of the production line, in order firstly to collect the batts into stacks, and secondly to transfer the stacked batts to a compression chamber provided with a pressure member for compressing the batts and a ram for discharging the compressed batts through a snout into a plastic bag placed over an outlet end of the snout.

Various attempts have in the past been made to feed the insulation batts directly from a conveyor into a compression apparatus, and from the compression apparatus into a bagging apparatus, without any manual handling of the batts, but these prior attempts have, in practice, not resulted in an apparatus and a process which operate satisfactorily.

For example, in Canadian Pat. No. 952,495 issued Aug. 6, 1974 to Gilles L. Vachon, there is disclosed a machine having indexing means for receiving batts from a conveyor, the indexing means comprising two sets of parallel bars intermittently rotatable about parallel, horizontal axes for indexing the batts sequentially and vertically downwardly into stacked relation onto one of a pair of support and compression plates, which are moved around respective endless paths so as to pass downwardly in succession through the indexing means for compressing the batts below the indexing means, a horizontal ram being provided for displacing the compressed batts through a bagging snout.

This prior apparatus has the disadvantage that it requires too many moving parts, which cause rapid wear and faulty operation, and moreover the indexing means is not only unduly complicated, and requires an undesirable intermittent motion, but also does not operate satisfactorily in practice.

In U.S. Pat. No. 3,908,539, issued Sept. 13, 1974 to Theodore Earl O'Brien, there is disclosed another apparatus for compressing batts of insulating material which has a conveyor arrangement for delivering the batts, two at a time, to a compression chamber, and a pair of pressure plates which are cycled through the compression chamber to compress the batts downwardly, a horizontal ram again being employed to discharge the compressed batts through a snout. Again, this prior art process has the disadvantage that it requires too many parts and, in fact, the pressure plates are required to move around a first path a predetermined number of times, and then around another path once, which again causes rapid wear and faulty operation.

OBJECT OF THE INVENTION

It is accordingly an object of the present invention to provide a novel and improved apparatus for compressing and packaging articles which requires a small number of moving parts and which operates more satisfactorily in practice than the above-described prior art apparatuses.

SUMMARY OF THE INVENTION

According to the present invention, an apparatus for compressing and packaging articles comprises a first, downwardly open chamber for receiving the articles, means for depositing successive batches of the articles in stacked relation into the chamber, a compression chamber located below the first chamber for receiving the articles therefrom and means for compressing the articles in the compression chamber. The compression means includes a pressure member and means for moving the pressure member around an endless path of movement including a first path section extending downwardly through the first chamber and a second path section extending upwardly at the exterior of the first chamber, whereby the batches of the articles are successively compressed into the compression chamber by movements of the pressure member down the first path section. Means are provided for retaining the articles under compression in the compression chamber, the compression means being movable between a first position located between the first chamber and the compression chamber to maintain the articles under compression when the pressure member leaves the first path section and a second position spaced from the first position. Means are provided for applying a covering to the compressed articles and a ram displaces the compressed articles from the compression chamber to the covering applying means.

Preferably, the displacing means is operated to displace the compressed articles only after more than one of the batches have been compressed in the compression chamber, and the pressure member is arranged to move comparatively slowly downwardly through the first chamber, carrying the articles thereon, and to withdraw laterally at a higher speed for depositing the articles.

By the use of the retaining means, which is preferably a horizontally slidable plate, the comrpessed articles are held securely in position in the compression chamber, and are thus prevented from expanding and becoming caught in the apparatus.

BRIEF DESCRIPTION OF THE DRAWINGS

Further features, advantages and objects of the present invention will be more readily understood from the following description thereof given with reference to the accompanying drawings, in which.

DESCRIPTION OF THE PREFERRED EMBODIMENT

Figure 1:
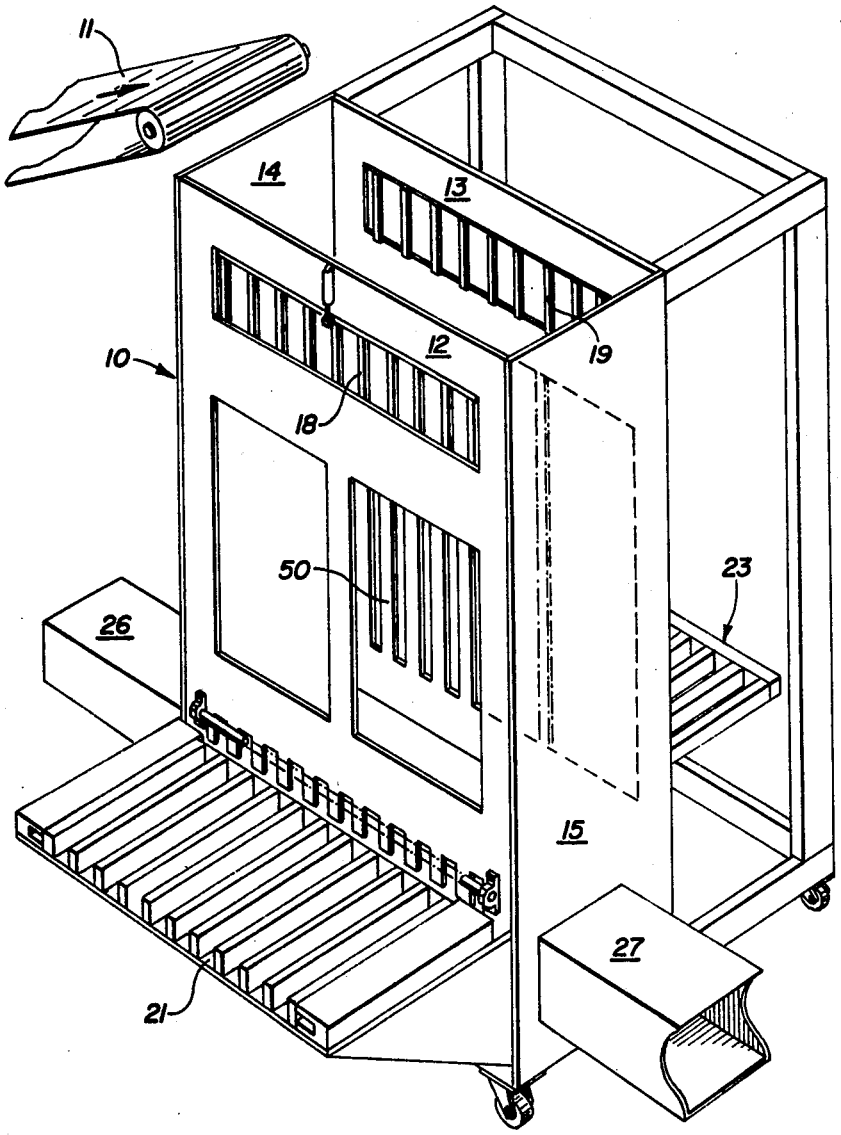
FIG. 1 shows a diagrammatic view in perspective of an insulation batt compressing and packaging apparatus embodying the present invention.

FIG. 1 shows an insulation batt compressing and packaging apparatus illustrated generally by reference numeral 10 for compressing and packaging insulation batts delivered sequentially to the top of the apparatus 10 and discharged thereto from an upwardly inclined endless conveyor 11.

The apparatus 10 has front and rear walls 12 and 13 and side walls 14 and 15 defining a rectangular opening extending downwardly from the top of the apparatus 10 for receiving the insulation batts.

A pair of pivotable batt retainer members in the form of bomb-bay door members 18 and 19 are mounted on the front and rear walls 12 and 13, respectively, a short distance below the open top of the apparatus 10 for temporarily retaining the insulation batts dropped thereto from the conveyor 11, as will be described in greater detail hereinafter.

The walls 12 to 15 define a compression chamber 20, and a slide plate 21 is horizontally slidable to and fro between a first position, in which the slide plate 21 extends into the space between the walls 12 to 15, and a second or withdrawn position, in which the slide plate 21 is displaced forwardly through the front wall 12 into the position in which it is shown in FIG. 1.

A batt compression member 23, the construction and operation of which is described in greater detail hereinafter, is movable to and fro in a vertical direction and is horizontally displaceable to and fro for compressing the insulation batts in the compression chamber 20.

A horizontally acting ram 25 (FIG. 2) is displaceable horizontally from a ram housing 26 through the side wall 14 to the side wall 15 for discharging the compressed horizontal batts through a bagging snout 27.

The apparatus hitherto described with reference to FIG. 1 will now be described in considerably greater detail with reference to FIGS. 2 to 6.

Figure 3:
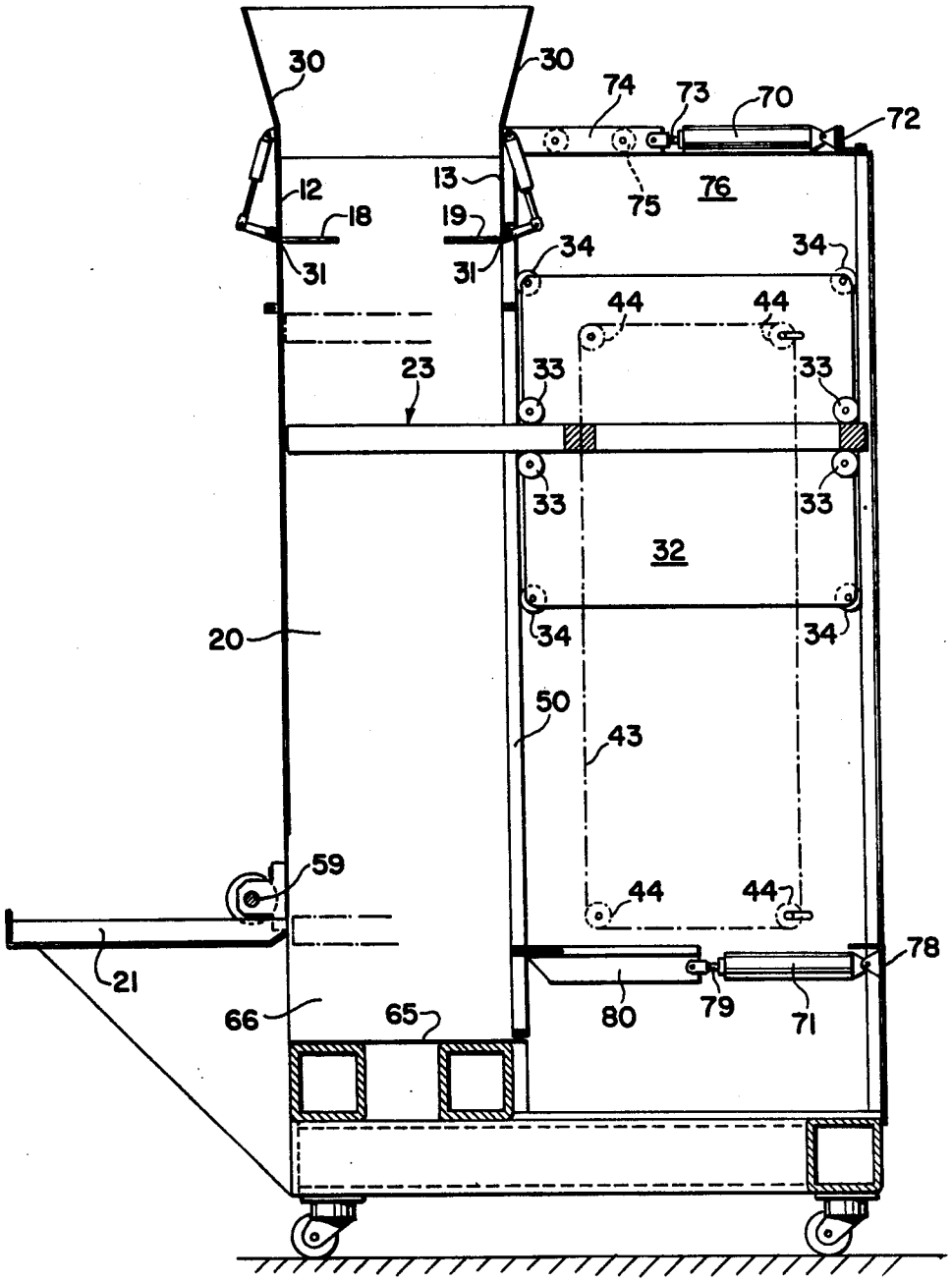
FIG. 3 shows a view taken in section along the line III—III of FIG. 2.
Figure 4:
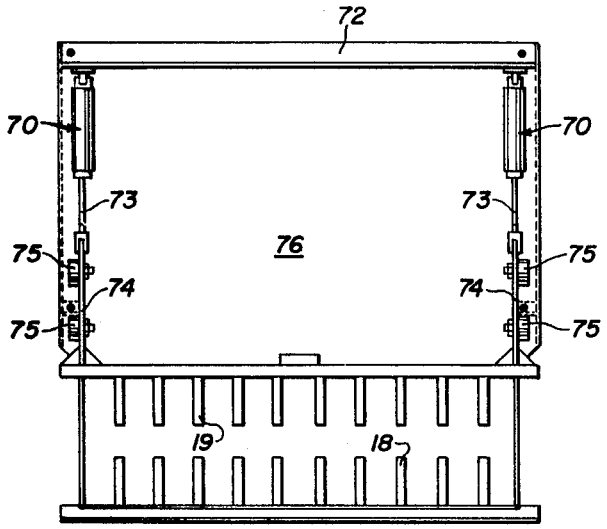
FIG. 4 shows a plan view of the apparatus of FIGS. 2 and 3.

As can be seen from FIG. 3, the front and rear walls 12 and 13 have upwardly and divergently outwardly inclined upper edge portions 30 for facilitating the dropping of the insulation batts from the conveyor 11 into the compression chamber 20.

Below the upper edge portions 30 of the walls 12 and 13, the bomb-bay doors 18 and 19 are pivotable, about parallel horizontal pivots 31, between closed positions, in which the bomb-bay doors 18 and 19 are shown in FIG. 3 and extend horizontally towards one another, and open positions (not shown) in which the bomb-bay doors 18 and 19 are pivoted downwardly from their closed positions to provide a space therebetween through which the insulation batts can fall downwardly through the compression chamber 20.

The compression member 23 is mounted between and movable relative to a pair of parallel, vertical, substantially square plates 32 (FIGS. 3 and 5) by means of pairs of rollers 33 contacting the upper and lower sides of the compression member 23, the plates 32 being supported by rollers 34 which run on upright frame members 35, which are spaced apart from one another at the rear of the rear wall 13.

Thus, the compression member 23 is horizontally displaceable to and fro, between the roller pairs 33 and relative to the side plates 32, between an extended position, in which the compression member 23 projects into the compression chamber 20 as shown in FIG. 3, and a retracted position, in which the compression member 23 is displaced to the right, as viewed in FIG. 3, from the compression chamber 20.

Figure 5:
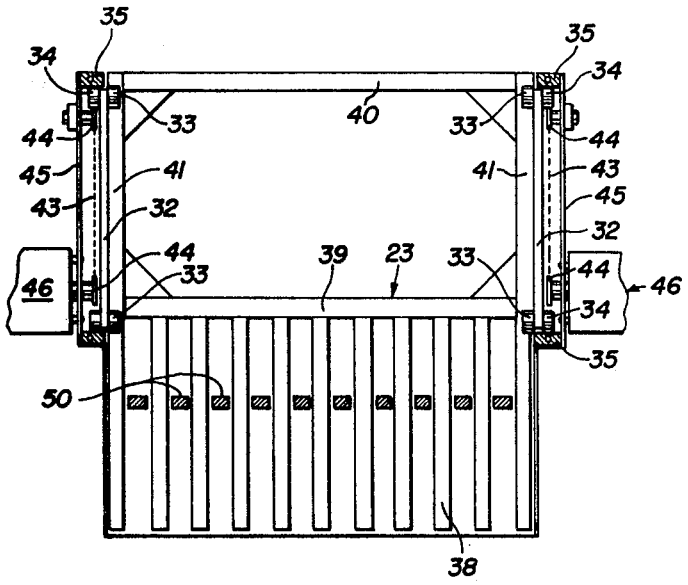
FIG. 5 shows a view taken in horizontal section along the line V—V of FIG. 2.
Figure 6:
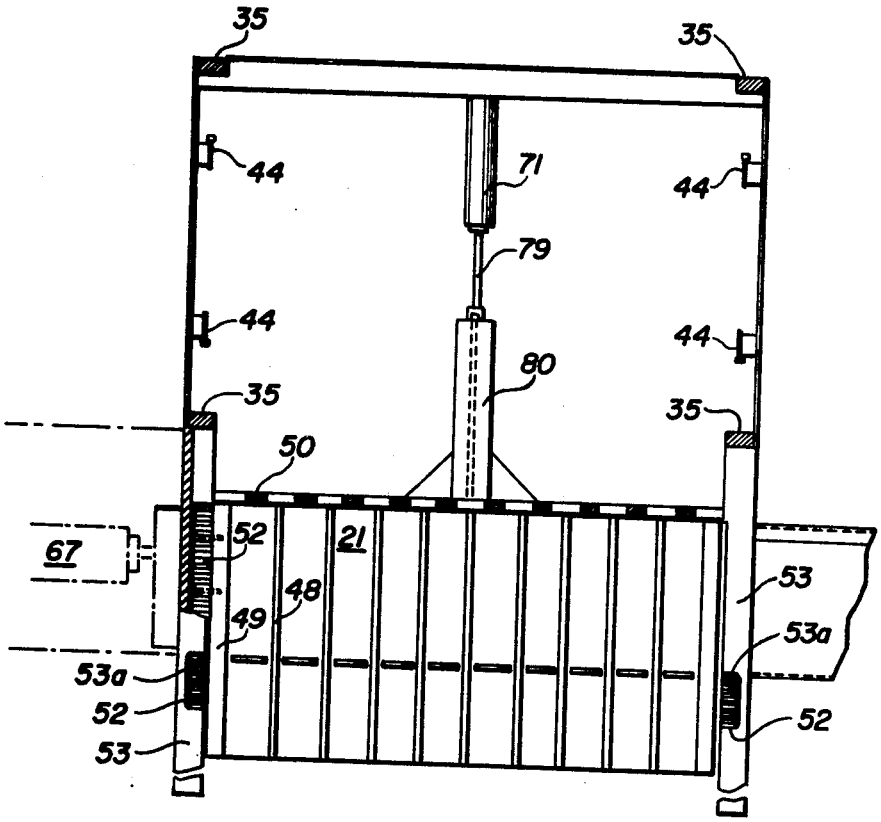
FIG. 6 shows a view taken in horizontal section along the line VI—VI of FIG. 2.

As will be seen from FIG. 5, the compression member 23 has, at its front, a plurality of mutually spaced, parallel, horizontal bars 38, which project forwardly from the front frame member 39 of a horizontal rectangular frame, which also comprises a rear frame 40 and opposite side frame members 41 perpendicular to the frame members 39 and 40. As will also be apparent from FIGS. 3 and 5, it is the side frame members 41 which extend between the roller pairs 33 for supporting the compression member 23 from the side plates 32, and the latter are in turn vertically movably supported on the uprights 35 by the rollers 34.

The uprights 35 serve as vertical guides for the rollers 34 during vertical movement of the side plates 32, and therewith the compression member 23, to and fro at the rear of the compression chamber 20.

The vertical movement of the side plates 32, and the horizontal movement of the compression member 23 between its extended and withdrawn positions, is effected by a pair of chain and sprocket drive transmissions respectively connected to the side plates 32 and each comprising a drive chain 43 extending around four sprockets 44. As shown in FIG. 5, the sprockets 44 are rotatably mounted on a pair of side walls 45, which are secured to the uprights 35, and air motors 46 are provided for driving one of the drive sprockets of each of the drive chain transmissions.

The drive chains 43 are connected to the side frame members 41 of the rectangular frame of the compression member 23 in alignment with the front frame member 39.

The rear wall 13 of the compression chamber 20, below the level of the bomb-bay door 19, is formed by a plurality of horizontally spaced, coplanar, vertical bars 50, between which the horizontal bars 38 of the compression member 23 extend, as shown in FIG. 5, when the compression member 23 is in its extended position.

Figure 2:
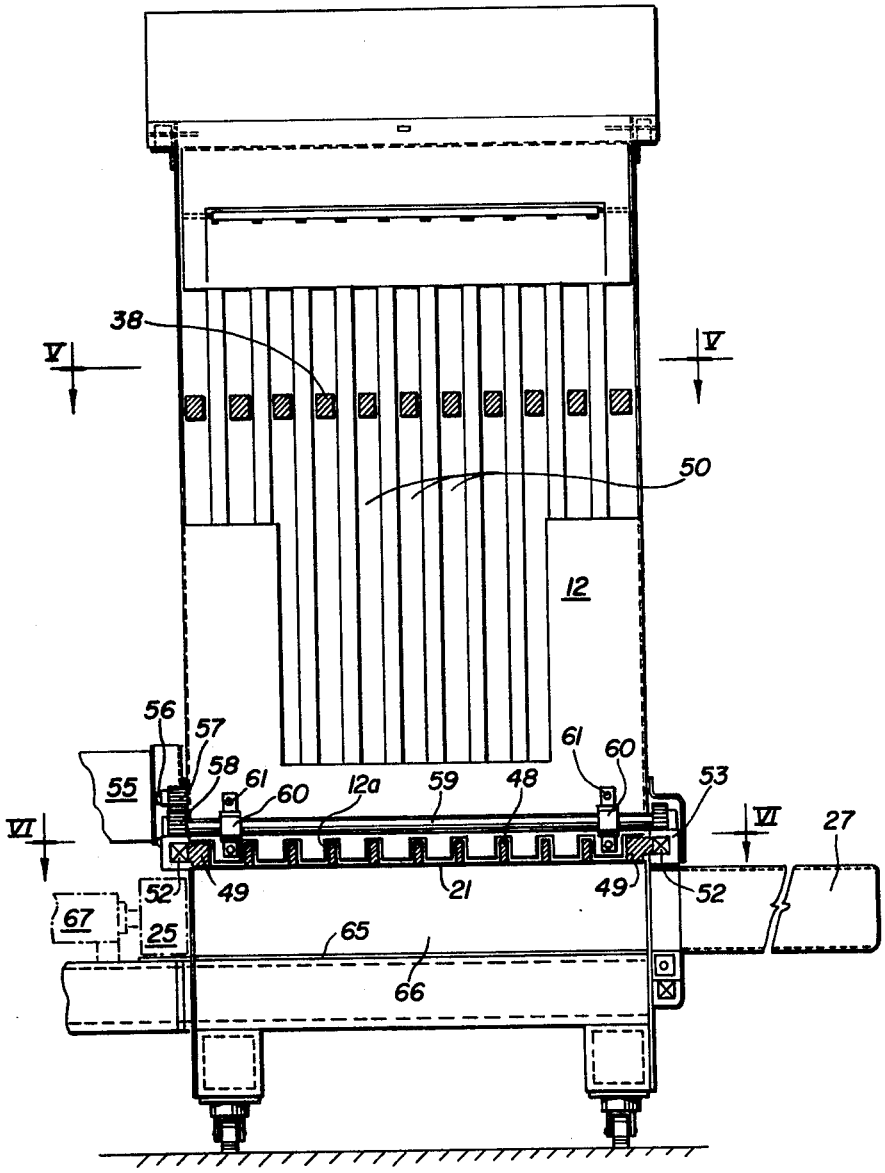
FIG. 2 shows a view taken in section along the line II—II of FIG. 3 and illustrating in greater detail a preferred embodiment of the apparatus illustrated in FIG. 1.

Referring now, in particular, to FIG. 2, it will be seen that the slide plate 21 has, welded to the upper surface thereof, a plurality of parallel, horizontally coplanar, horizontally spaced vertical bars 48 and, at its opposite ends, a pair of rails 49, to which are bolted respective racks 52. A pair of horizontal guide channels 53 slidably receive the racks 52 and thus guide the racks 52, and therewith the slide plate 21, for horizontal movement. The guide channels 53 are formed, at their uppermost sides, with cut-outs 53*a*.

For effecting such horizontal movement, an air motor 55 has, on its output shaft 56, a pinion 57 meshing with one of a pair of spur gears 58 secured to the opposite ends of a horizontal shaft 59, whichis rotatably supported in pillow blocks 60 mounted by bolts 61 on the front face of the front wall 12 of the compression chamber 20. The gears 58 mesh with the racks 52 through the cut-outs 53*a*. Thus, by operation of the air motor 55 in opposite directions, the slide plate 21 can be horizontally displaced to and fro from a withdrawn position, in which it is shown in FIG. 3 and in which it is displaced forwardly from beneath the compression chamber 20, to an extended position, in which it is displaced to the right, as viewed in FIG. 3, past the front wall 12 to the rear wall 13 of the compression chamber 20, the bars 48 passing through castellations or cut-outs 12*a* in the front wall 12.

At a spacing beneath the inwardly extended position of the slide plate 21, there is provided a horizontal plate 65 which, as will become more readily evident as this description proceeds, serves as a horizontal support for the insulation batts during the final compression of the batts in a compression space 66 at the upper surface of the horizontal plate 65.

The horizontally acting ram 25 (FIG. 2), is displaceable by a pneumatic piston and cylinder 67 from a retracted position, in which it is shown in FIG. 2, over the upper surface of the plate 65 for discharging the compressed insulation batts therefrom through the bagging snout 27.

In order to allow the apparatus to be adapted to insulation batts of different widths, the rear wall 13 of the compression chamber is horizontally displaceable to and fro by an upper pair of air cylinders 70 and a lower cylinder 71.

The upper air cylinders 70 are each connected, at their rearmost ends, to a channel member 72, which is bolted to the rear of the top of the apparatus, and connected by a piston rod 73 to one end of a link 74, the other end of which is connected to the rear side of the rear wall 13. The links 74 are provided with rollers 75 which run on a top plate 76, mounted on the tops of the uprights 35, the rollers 75 serving to avoid friction between the links 74 and the top plate 76.

The lower cylinder 71 is connecgted at its rear end to a horizontal channel member 78 extending between the two rearmost uprights 35, and has its piston rod 79 connected to a bracket 80 extending rearwardly from the rear wall 30.

The operation of the above-described apparatus will now be described.

However, before the sequence of steps performed by this apparatus to compress and package the insulation batts is described, a more detailed explanation of the operation of the compression member 23 will be given.

As mentioned hereinbefore, the compression member 23 is connected to the chains 43 driven by the air motors 46. During operation of the apparatus, the sprockets 44 rotate anticlockwise, as viewed in FIG. 3, and thus the compression member 23 is shown in FIG. 3 during downward movement of the compression member 23 through a first section of its endless path which first section extends from the level of the uppermost pairs of sprockets 44 to the lowermost pair of sprockets 44. It will be noted that, at the bottom of this first section of its path of movement, the compression member 23 is level with the slide plate 21. When the compression member 23 reaches this position, the air motor 55 is operated to initiate movement of the slide plate 21 from its withdrawn position in the right-hand direction, as viewed in FIG. 3, so that the leading edge of the slide plate 21 abuts the front ends of the horizontal bars 38 of the compression member 23.

As the points of connection of the compression member 23 pass around the front, lowermost sprockets 44 and begin to travel in a rearward direction, the compression member 23 likewise travels in the same direction and is thus withdrawn from between the walls 12 and 13. When the compression member 23 reaches the rearward limit of this horizontal section of its path of movement, it then begins to travel upwardly between and beyond the rearmost pairs of sprockets 44 until it reaches the level of the uppermost pairs of sprockets 44, whereupon it is again displaced forwardly into the chamber 20 prior to its next descent through the latter.

The cycle of operation of the above-described apparatus for compressing and packaging the insulation batts will now be described with reference to FIGS. 7*a* to 7*t*.

Figures 7A, 7B, 7C, 7D, 7E, 7F, 7G, 7H, 7I, 7J:
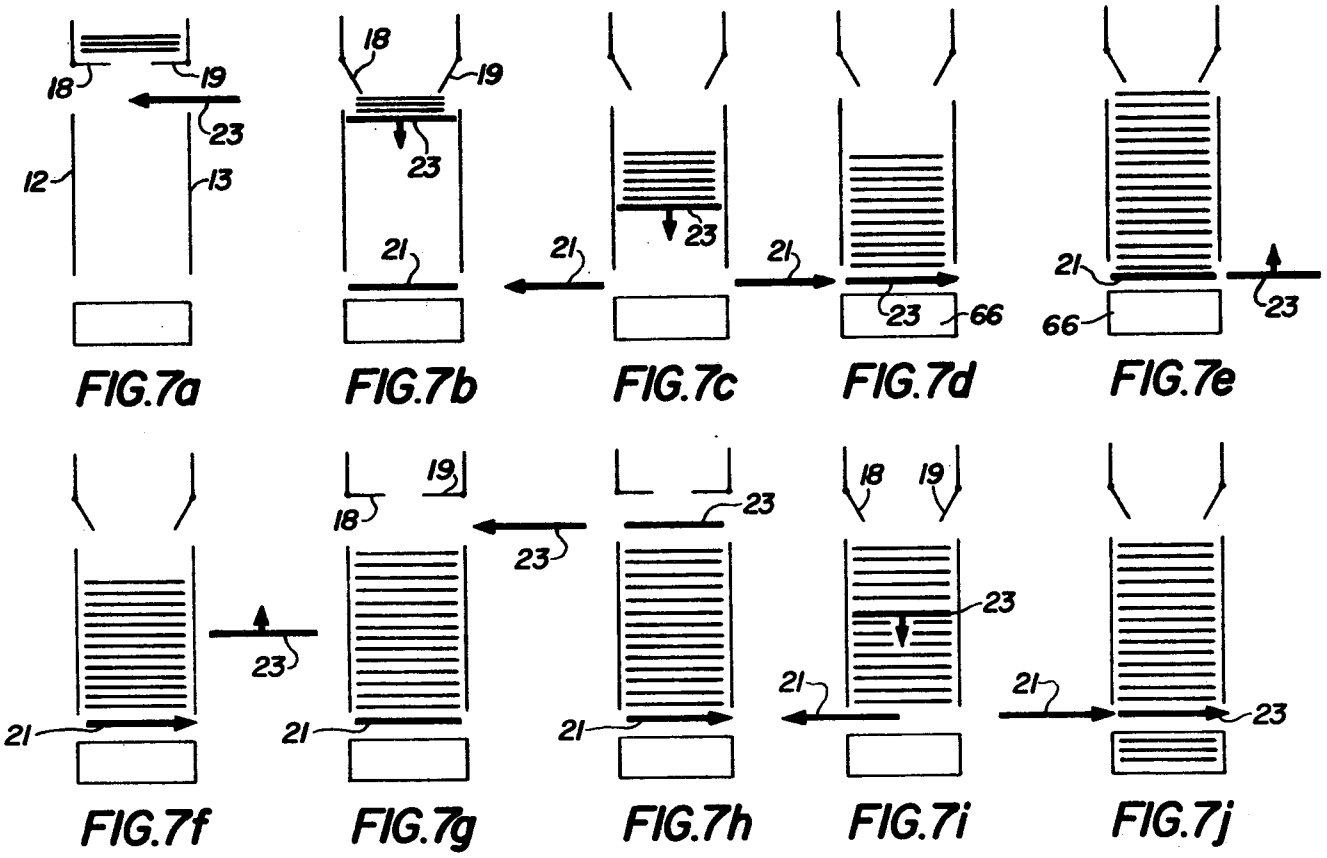
FIGS. 7*a* to 7*u* shows diagrammatic views taken in cross-section through the apparatus of FIGS. 2 to 6 and illustrating successive steps in the compression and packaging of insulation batts.

The insulation batts, indicated by reference numeral 82 are successively discharged from the upper end of the upwardly inclined conveyor 11 so as to form a stack in the bomb-bay doors 18 and 19 as shown in FIG. 7*a*.

The bomb-bay doors 18 and 19 then open as shown in FIG. 7*b* to allow the batts to drop onto the top of the bars 38 of the compression member 23 as the latter moves downwardly through its first path section, the opening of the bomb-bay doors being timed, in relation to the movement of the compression member 23, so that the batts have a relatively small distance to drop onto the compression member 23.

The compression member 23 continues to move down through its first path section as shown in FIG. 7*c* until it reaches the bottom of this first path section, as shown in FIG. 7*d*, whereupon it is displaced horizontally, to the right as viewed in FIG. 7. Simultaneously, the slide plate 21 is displaced to the right, as viewed in FIGS. 3 and 7*d*, from its withdrawn position to its extended position, shown in FIG. 7*e*, to support the batts.

The compression member 23 then travels upwardly, as described hereinbefore and as indicated in FIG. 7*f*, and then horizontally, until it is disposed once again below the bomb-bay doors 18 and 19, which at this time are closed.

The compression member 23 then moves downwardly again through its first path section, as shown in FIG. 7*i*, and the slide plate 21 is retracted to its withdrawn position, so that the batts underlying the compression member 23 are compressed thereby into the compression space 66. As can also be seen in FIG. 7*i*, the bomb-bay doors reopen shortly after the compression member 23 begins to move downwardly through the chamber 20, so that further articles are deposited on the top of the compression member 23.

When the compression member 23 again reaches the bottom of its first path section, as shown in FIG. 7*j*, the slide plate 21 and the compression member 23 again move to the right, so that the compressed batts in the compression space 66 are held in their compressed condition by the slide plate 21 during the subsequent travel of the compression member 23 as illustrated in FIGS. 7*k* to 7*n*.

Figures 7K, 7L, 7M, 7N, 7O, 7P, 7Q, 7R, 7S, 7T, 7U:
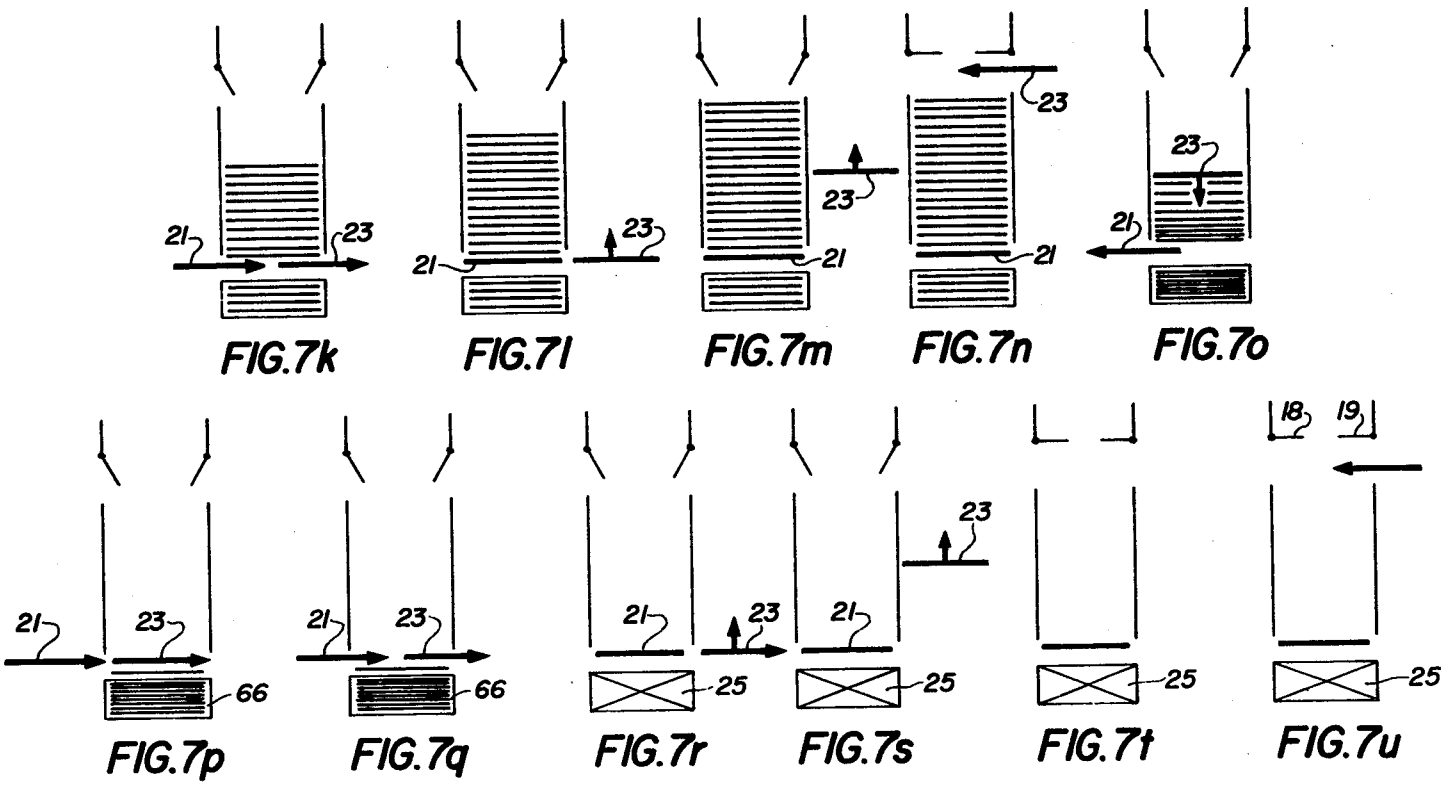

When the compression member 23 again descends through the chamber 20, as shown in FIGS. 7*o* and 7*p*, the slide plate 21 is again withdrawn and more of the batts are compressed into the compression space 66 on top of the compressed batts already disposed in the compression space 66.

The slide plate 21 then returns to its extended position, as shown in FIG. 7*g*, and thus retains all of the compressed batts in the compression space 66.

The horizontally acting ram 25 is then operated to discharge the compressed batts, in a direction perpendicular to the plane of FIG. 7, from the compression space 66 through the bagging snout 27, at which the bags are discharged into a plastic bag (not shown) in a manner well known to those skilled in the art.

We claim:

1. Apparatus for compressing and packaging articles, comprising:

an upwardly open chamber for receiving the articles;

means for depositing successive batches of the articles in stacked relationship into said first chamber;

a compression space located at the bottom of said chamber;

means for compressing the articles in said compression space;

said compression means including a pressure member and means for moving said pressure member around an endless path of movement including a first path section extending downwardly through said chamber and a second path section extending upwardly at the exterior of said chamber, whereby said batches of the articles are successively compressed into said compression space by the movement of said pressure member down said first path section;

means for retaining the articles under compression in said compression space;

said retaining means being movable between a first position located above said compression space and a second position spaced therefrom;

means for displacing said retainer into said first position to maintain the articles under compression when said pressure member leaves said first path section;

means for applying a covering to the compressed articles; and means for displacing the compressed articles from said compression space to said covering applying means.

2. Apparatus as claimed in claim 1, wherein said retaining means comprise a retainer member mounted for horizontal to and fro movement between said first and second positions, and said compression means include means for horizontally guiding said pressure member from the bottom of said first path section along a third path section to said second path section.

3. Apparatus as claimed in claim 2, wherein the path of the to and fro movement of said retainer member is horizontally aligned with said third path section.

4. Apparatus as claimed in claim 1, further comprising means for operating said depositing means to deposit one of said batches into said first chamber during each movement of said pressure member down said first path section, whereby the articles are deposited onto said pressure member for downward movement thereon.

5. Apparatus as claimed in claim 1, wherein said depositing means comprise a pair of support members movable between a closed position, in which said support members are horizontal and coplanar, and an open position, in which said support members are moved apart to provide a gap sufficient for the articles to drop therebetween.

6. Apparatus as claimed in claim 1, wherein said chamber has at least one movable wall and means for horizontally displacing said movable wall to adapt said first chamber to different article sizes.

7. Apparatus as claimed in claim 1, further comprising upwardly inclined conveyor means for discharging the articles in succession into said depositiong means.

8. Apparatus for compressing and packaging batts of insulating material, comprising:

an upwardly open chamber for receiving the batts in succession through the open top thereof;

a compression chamber located beneath said chamber;

means for downwardly compressing the batts from said upwardly open chamber into said compression chamber;

said compression means including a pressure member and means for repeatedly moving said pressure member around an endless path of movement including a first path section extending downwardly through said upwardly open chamber and a second path section extending upwardly at the exterior of said upwardly open chamber, whereby successive batches of the articles are compressed into said compression space by the successive movements of said pressure member down said first path section;

means for retaining the batts under compression in said compression chamber;

said retaining means being movable between a first position located above said compression space and a second position spaced therefrom;

means for displacing said retainer into said first position to maintain the batts in the compression chamber under compression when said pressure member leaves said first path section, whereby two successive batches are compressed together in the compression chamber;

means for applying a convering to the compressed articles; and means for simultaneously displacing the two compressed batches from said compression chamber to said covering applying means.

9. Apparatus as claimed in claim 8, further comprising batt holding means disposed at a spacing above the first path section for temporarily retaining and thereby stacking the batts, said batt holding means comprising support members movable into closed positions for supporting the batts thereon and open positions in which said support members are spaced sufficiently to allow the batts to drop therebetween into the first path section.

10. Apparatus as claimed in claim 9, further comprising an upwardly inclined conveyor for discharging the batts in succession into said batt holding means.

11. Apparatus as claimed in claim 8, further comprising an upwardly inclined conveyor for delivering the batts to said first path section.

12. Apparatus as claimed in claim 8, wherein said retaining means comprises a batt retainer member and means for displacing said batt retainer member to and fro between the first and second positions, said first position being located at the bottom of the first path section.

* * * * *